US009476682B1

(12) United States Patent
Powell et al.

(10) Patent No.: US 9,476,682 B1
(45) Date of Patent: Oct. 25, 2016

(54) MULTI-CHARGE MUNITIONS, INCORPORATING HOLE-BORING CHARGE ASSEMBLIES

(75) Inventors: Kevin Mark Powell, Kent (GB); Edward Evans, Maidstone (GB)

(73) Assignee: QINETIQ LIMITED, Farnborough (GB)

( * ) Notice: Subject to any disclaimer, the term of this patent is extended or adjusted under 35 U.S.C. 154(b) by 0 days.

(21) Appl. No.: 07/466,711

(22) Filed: Jan. 9, 1990

(30) Foreign Application Priority Data

Jan. 26, 1989 (GB) ..... 8901667

(51) Int. Cl.

| | |
|---|---|
| ***F42B 12/10*** | (2006.01) |
| ***F42B 12/12*** | (2006.01) |
| ***F42B 12/16*** | (2006.01) |
| ***F42B 12/14*** | (2006.01) |
| ***F42B 1/028*** | (2006.01) |
| ***F42B 1/032*** | (2006.01) |
| *F42B 25/00* | (2006.01) |
| *F42B 3/08* | (2006.01) |

(52) U.S. Cl.
CPC ..... *F42B 12/16* (2013.01); *F42B 1/028* (2013.01); *F42B 1/032* (2013.01); *F42B 12/10* (2013.01); *F42B 12/12* (2013.01); *F42B 12/14* (2013.01); *F42B 3/08* (2013.01); *F42B 25/00* (2013.01)

(58) Field of Classification Search
CPC ..... F42B 12/00; F42B 12/10; F42B 12/12; F42B 12/14; F42B 12/16; F42B 12/18; F42B 12/58; F42B 12/60; F42B 12/62; F42B 25/00; F42B 3/08; F42B 1/02; F42B 1/028; F42B 1/032
USPC ..... 102/305–310, 364, 393, 475, 476, 489
See application file for complete search history.

(56) References Cited

U.S. PATENT DOCUMENTS

| | | | | |
|---|---|---|---|---|
| 2,984,307 A | | 5/1961 | Barnes | 175/2 |
| 3,750,582 A | * | 8/1973 | Kintish et al. | 102/476 |
| 4,493,260 A | | 1/1985 | Foster | 102/307 |
| 4,726,297 A | * | 2/1988 | Bueno et al. | 102/489 |
| 4,989,517 A | * | 2/1991 | Adimari et al. | 102/489 |

FOREIGN PATENT DOCUMENTS

| | | | | |
|---|---|---|---|---|
| DE | 3010917 | * | 10/1981 | 102/476 |
| DE | 2829002 C2 | | 4/1985 | |

(Continued)

OTHER PUBLICATIONS

Hunting Engineering sales brochure SG357, 1986 Aircraft Armament/UK.

*Primary Examiner* — James S Bergin
(74) *Attorney, Agent, or Firm* — Nixon & Vanderhye P.C.

(57) ABSTRACT

Multi-charge munition suitable for defeating a concrete target consists of a detonatable array of hollow primary charges (14) of explosive supported laterally of a line of target penetration on which is disposed a secondary explosive charge (48). Simultaneous detonation of the primary charges in the array causes jet penetrators to be projected together towards the target which produce wide boreholes in concrete suitable for the subsequent emplacement and detonation of the secondary charge. The munition may be an aerially-deliverable bomb or submunition.

In one preferred embodiment, the primary charges (14) are positioned in a convergent configuration behind a forwardly-tapered secondary charge (48). Detonation of the primary charges projects penetrators forwardly passed the sides of the secondary charge and thrusts the secondary charge into the borehole produced in the target by the penetrators.

25 Claims, 14 Drawing Sheets

(56) References Cited

FOREIGN PATENT DOCUMENTS

| | | | | | |
|---|---|---|---|---|---|
| DE | 2629280 C1 | 7/1985 | | | |
| DE | 3544528 C1 | 4/1987 | | | |
| EP | 0159389 | 8/1984 | | | |
| EP | 176045 | * | 4/1986 | ..... | 102/476 |
| FR | 89303 | * | 1/1967 | ..... | 102/476 |
| GB | 703207 | 1/1954 | | | |
| GB | 1051407 | 12/1966 | | | |

* cited by examiner

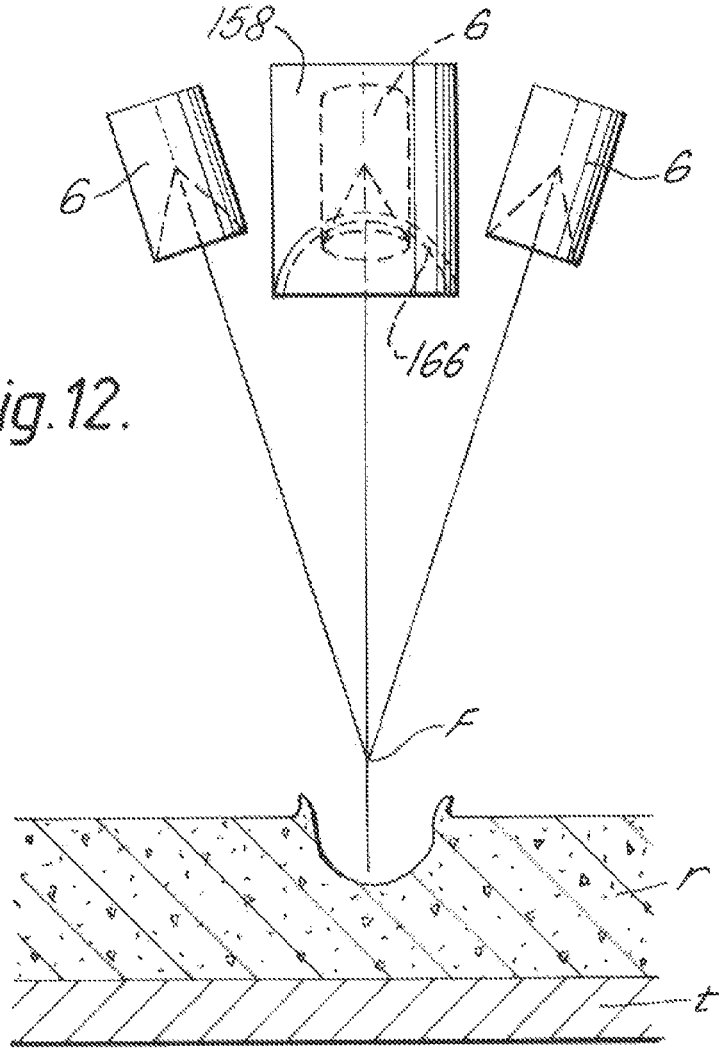
Fig.12.
Fig.13.
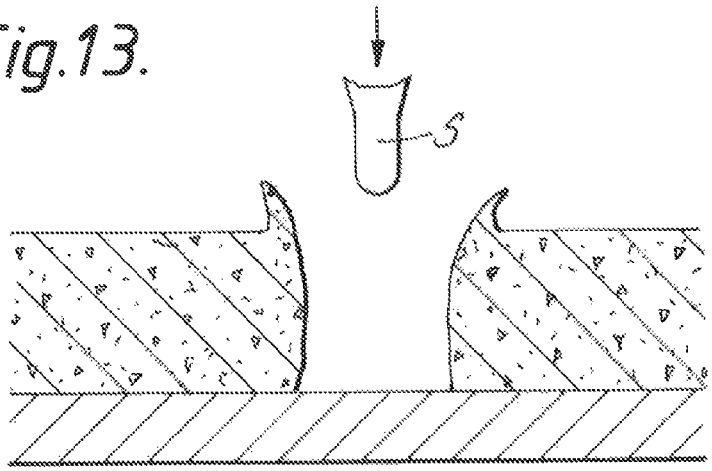

MULTI-CHARGE MUNITIONS, INCORPORATING HOLE-BORING CHARGE ASSEMBLIES

BACKGROUND OF THE INVENTION

1. Field of the Invention

This invention relates to multi-charge munitions incorporating hole boring charge assemblies, in particular hole-boring charge assemblies capable of penetrating concrete targets.

2. Discussion of Prior Art

It is known that the attack, disruption, and destruction of fixed targets such as airfield runways, shelters, bunkers, bridges, roadways, railway marshalling yards and dockyards may be effected by first emplacing and then detonating relatively small quantities of high explosive within or under the target. The materials of construction of these targets are typically strong in compression and yet weak in tension, as exemplified by most forms of concrete. Such emplacement exploits both the inherent confining effect of the target material on the charge of emplaced explosive and the tensile weakness of the target material, and futhermore enhances the transmission of energy from the detonated explosive into the immediately adjacent confining medium and onwards into the outlying and underlying target structure.

One known technique of rapid implantation and detonation of explosive charges into fixed targets is to first breach the surface of the target with a hole-boring charge of explosive before driving a secondary charge of explosive into or through the hole so formed, and thereafter initiating detonation of the secondary charge. This technique has the advantage that it may be used in both the manual demolition of fixed targets, in which the hole boring and secondary charges will usually be brought separately and sequentially to the target, and in the attack of such structures by remotely-delivered munition systems such as aerially-deliverable bombs, missiles and shells which systems incorporate both types of charge and a suitable delay device for initiating detonation of the secondary charge.

The main requirement for a hole boring charge as applied to fixed targets is that it should be capable of producing a breach in the target of sufficient width and depth of penetration to permit subsequent emplacement of the secondary charge at a position which will cause enhanced damage to the structure once the secondary charge is detonated. The hole may be large enough to permit complete emplacement of the secondary charge within or even under the target. Alternatively, it may only be large enough to permit a remotely delivered secondary charge to lodge partly in the hole, but this at least has the advantage that it prevents ricochet of the secondary charge away from the target before detonation. In a remotely-delivered munition system in particular, the hole-boring charge should also preferably be of relatively small size and weight in comparison with that of the secondary charge because it is for the most part the latter charge which performs the task of destroying the target.

These requirements have in the past been met in part by the use of a hollow explosive charge having a conical concavity in one face lined with a non-explosive liner. The hollow and secondary charges are configured in what is known as a follow-through munition, in which the hollow charge is positioned axially in front of the secondary charge. When the hollow charge is detonated, the liner collapses upon its axis and is formed into a high velocity jet which upon impact with the target produces a hole. The secondary, follow-through charge is thrust into the hole so formed, either by virtue of its own forward momentum if sufficient to overcome blast-back forces from the hole, or under the influence of an auxiliary charge positioned to the rear of the follow-through charge. However, such known hollow charges fail to fulfil all the requirements for a variety of reasons.

Hollow charges with concavities having acutely-angled apexes generally collapse the liner into long, narrow, high speed jets. These are capable of penetrating both massive structures and armour to considerable depths. However the resulting holes bored in the target material tend to be narrow and tapered and so are not suitable for the subsequent emplacement of a blasting charge therein. The diameter of the hole can be increased by increasing the diameter of the hollow charge, but the corresponding increase in weight of the hollow charge is undesirable and furthermore the increase in target penetration in targets of finite thickness such as concrete walls, roads and runways may cause the secondary, follow-through charge to be emplaced beyond the depth at which it can cause maximum damage to that target.

Wider holes are also produced for the same calibre of hollow charge using shallower angled, lined concavities (ie concavities with large-angled apexes, of apex angles generally greater than 80°, especially greater than 100°) which generally form the liners into projectiles which tend towards lower velocity, non-jet penetrators. However, the shorter lengths and lower kinetic energies of these penetrators result in a significant reduction in performance especially against concrete targets, necessitating an undesirably large charge mass in order to excavate a hole of sufficient volume to permit emplacement of the secondary, follow-through charge to an optimum depth.

The need for a relatively large mass of explosive in the hole-boring hollow charge reduces the weight of explosive which can be used in the secondary, follow-through charge for a given overall weight of multi-charge munition, and when the hole-boring charge is detonated consequently gives rise to excessively large forces on the follow-through charge which may damage the follow-through charge and/or its fuzing system.

SUMMARY OF THE INVENTION

It is one of object of the present invention to provide a multi-charge munition incorporating a hole-boring charge assembly which can more adequately facilitate the emplacement of a follow-through charge within a target.

Accordingly, the present invention provides a multi-charge munition for attacking a target, comprising a secondary charge of explosive disposed on a fore-and-aft line of target penetration, a detonatable array of at least two hollow primary charges of explosive supported laterally about the line of target penetration, each primary charge having a recessed forward face, a liner of non-explosive material lining said forward face, and being geometrically configured, when detonated in the array, to project a penetrator derived from the liner along a line of tajectory extending forwards of the secondary charge, a fuze system arranged to initiate detonation of the array of primary charge and the secondary at appropriate times, and a primary detonation means for detonating the primary charges in the array in a temporal relationship with respect to one another such that the penetrators are projected forwards towards the target concurrently.

The effect of two or more linearly projected penetrators impacting concurrently on a target has been found to vary depending on whether the penetrators penetrate the target separately or as one. However, the present arrangement of hollow charges has been found to produce holes in a target material such as concrete of a volume which is significantly larger than that which could be produced by a single hollow charge of the same overall mass and linear geometry.

The mode of failure of a target material such as concrete and the subsequent formation of the borehole is complex but the following which does not in any way limit the scope of the invention provides an explanation of the possible mechanics involved.

If the primary charges of the array are geometrically arranged so that the penetrators converge and meet at a focal point before or, more preferably, soon after penetrating the target, it has been found that a single coalesced penetrator will form which surprisingly has little tendency to diverge from its resultant trajectory, especially if the array contains three or more, equispaced primary charges. The resultant penetrator tends to retain approximately the same energy density as the separate penetrators from which it is formed, so that a significant depth of target penetration in both high and low tensile strength materials is maintained. However the hole produced in target materials such as concrete is found to be very much wider than would have been expected from that produced by a single hollow charge of similar linear geometry and equivalent mass. Furthermore, the resultant, coalesced penetrator dissipates its energy rapidly when it comes into contact with softer material such as sand, soil, clay or gravel which may underlie a ground target such as an airfield runway or a roadway, leaving a bulbous cavity below the target which is ideally shaped for the subsequent emplacement of a secondary, cratering charge.

Ideally, the penetrators meet soon after penetrating the target and for this reason the fuze system preferably includes a primary fuze means arranged to initiate detonation of the primary charges when the focal point is located beneath the surface of the target.

It has been found that a coalesced penetrator of optimum penetration efficiency and hole boring characteristics is produced by so arranging the primary charges that the penetrators meet at a distance from the base of each charge recess (ie from the forward face of each charge) of between two and twenty times, preferably between two and ten times, particularly between three and seven times, the diameter of the liner. A distance of a minimum of two diameters is required adequately to form the collapsed liners into penetrators, whereas at a distance of greater than seven base diameters the penetrators tend to break up and become increasingly particulate and at a distance of greater than ten diameters, it becomes increasingly difficult to focus the charges in the array acurately. The most preferred upper limit of distance is therefore at the point at which the onset of particulation occurs for each single charge. In any event, unless a large and yet relatively shallow hole is required, the penetrators will collide at angles of preferably not greater than 90°, more preferably not greater than 60°, most preferably not greater than 30° to one another in order to prevent a significant reduction in kinetic energy transmission in the direction of target penetration.

If the primary charges in the array are not focussed, then the array must contain at least three primary charges. The initial effect of three or more non-focussed primary hollow charge penetrators impacting concurrently on a target is to bore a number of narrow, deep holes into the target equal to the number of hollow charges detonated. The collision of the penetrators with the target material produces intense shock waves which radiate outwards from the holes as they are formed. The strength of the shockwaves radiating from each penetrating jet is sufficiently large to cause material immediately adjacent the holes produced to fail in compression. In the case of impact by a single hollow charge jet, shock wave intensity decreases with distance of travel into the target, and damage is limited to the immediate vicinity of the hole. However, when three or more jets impact concurrently on the target, the transmitted shock waves from adjacent jets are reflected upon collision, and in the process of collision subject the target material to intense compression thus extending the region of failure to encompass the material bounded by the holes. This material may be ejected from the surface of the target upon its subsequent relaxation immediately following compression, an effect which may be assisted by gases generated during penetration by the jets, to leave behind a single and relatively wide resultant borehole encompassing the narrow holes initially formed by the individual penetrators. Thus, the present array of hollow charges exploits the efficient hole boring and rapid energy dissipation characteristics of explosively-formed penetrators, especially jet penetrators, but at the same time produces a much larger hole suitable for subsequent emplacement of the secondary charge.

For this effect to be produced, it is not essential that the primary charges should be arranged to produce penetrators which are projected along parallel pathways, although the arrangement should be such that the penetrators preferably produce a non-linear array of impact points on the surface of the target so that the lines of trajectory encompass a finite volume of target material. By appropriate geometric arrangement of the individual charges within the array, the penetrators may diverge or converge slightly, though preferably at an angle of not more than 30°, more preferably not more than 20°, to a line parallel to the line of target penetration. Divergent penetrators will produce a shorter, wider resultant hole because the relaxation effect will diminish with increasing distance into the target, whereas slightly convergent penetrators will tend to produce a deeper and slightly tapered hole which is more preferred for the purpose of secondary charge emplacement.

Since it will be understood that each of the individual penetrators do not by themselves contribute significantly to the width of the resultant hole produced by either of the effects described above in relation to focussed and non-focussed penetrators, it is therefore advantageous to provide a design of hollow charge which produces maximum depth rather than maximum width of penetration. Hollow charge and liner combinations which produce very long jet penetrators are therefore preferred. Hitherto, such combinations have not been employed in multi-charge munitions for attacking concrete targets because singly they normally produce deep, narrow, tapered holes of little use for the emplacement of secondary charges. In order to maximise the kinetic energies that can be attained by such jets, the non-explosive liners are preferably of relatively low density ductile materials having densities of less than 5 gm $cm^{-3}$. Aluminium and alloys thereof are especially preferred, although plastics (such as polyethylene) and metal-loaded plastics may also be used, for example plastics loaded with up to 50% by weight of particulate aluminium or particulate aluminium alloy. Such low density materials can be formed into jet penetrators from much deeper recesses than traditional, high density shaped charge liner materials such as copper, so that within certain limits much higher penetrator velocities hence kinetic energies are possible with the former. The charges themselves are preferably axisymmetric with conical recesses which are commonly referred to as shaped charges, and using these low density liners the apex angle of the correspondingly conical liners is preferably from 15° to 70°, more preferably from 20° to 55°, most preferably from 25° to 50°.

The array preferably contains up to 6 hollow primary charges and is normally provided in a symmetrical form with the primary charges preferably equispaced about the line of target penetration and preferably lying in a plane normal to that line. For a non-focussed array of charges (which term also encompasses slightly convergent arrays), the most preferred number of charges is four, (especially if the charges are positioned in a substantially square array), since the hole produced by a triangular array of only three charges will significantly reduce the maximum diameter of the secondary charges which can be successfully emplaced. For a focussed array of charges, in which the charges are arranged such that the penetrators meet preferably before they particulate, the most preferred number of charges in the array is three, this being the minimum number required to produce a reasonably axisymmetrical, coalesced penetrator. In symmetrical arrangements the charges will normally be arranged to be detonated simultaneously, although in other arrangements a rapid succession of detonations may be advantageous. A relatively closely-spaced array is preferred especially when the charges are non-focussed, the centres of gravity of the primary charges being located within a pitch circle diameter of preferably less than 6 primary charge widths, more preferably less than 4 primary charge widths.

When the hollow charges are in a focussed configuration, at least two of the liners may be of different materials, especially of different materials which interreact exothermically when the penetrators coalesce. This can produce a significant pressure increase within the target during penetration, which can enhance the hole boring effect. An example of three different liner materials which when coalesced may together produce this effect are zirconium, titanium, and iron. In this particular case, the liner may comprise a hollow cone with an apex angle of between 20° and 120° or a hemispherical cap, the latter being commonly referred to as a Miznay Schardin dish.

In order to reduce the overall volume of the multi-charge munition for storage purposes, advantageously the primary charges are laterally displaceable on a moveable support mechanism from a confined, clustered configuration to their detonatable positions in the array. If the munition is aerially-deliverable, this arrangement can also be used to improve its flight characteristics since lateral deployment of the primary charges can be delayed until the munition approaches close to its target. An energising means such as a gas generator may be employed to deploy the primary charges. A latch means is preferably also provided for restraining the primary charges once displaced to their detonatable positions in the array by the moveable support mechanism. If the primary charges are retained in their own housing, then in order to facilitate deployment of the charge it is preferred that the housing is petalled. The housing petals are closed when the primary charges are in their clustered configuration, and open hingedly when the charge are laterally displaced outwards to their positions in the detonatable array.

The secondary charge will generally be of larger mass than each of the primary charges. It may comprise a blasting or cratering charge. Alternatively, it too may comprise a hollow charge have a recessed forward face lined with a non-explosive liner, especially if the primary charges are configured in a convergent or focussed array to provide an initial borehole for subsequent, further penetration by the secondary hollow charge.

The array of primary munitions may be arranged in a follow-through, lateral or reverse follow-through configuration with respect to the secondary charge.

In the follow-through configuration, the primary charges are located in front of the secondary charge. The munition may be provided with an auxilliary, thruster charge behind the secondary, follow-through charge in order to counteract the rearward blast from the detonated array of primary charges. Alternatively, if the follow through charge is very large in comparison to the size of the primary charges and comprises, for example, a free-fall bomb then its forward inertia may be high enough to carry it at least partly into the target without the need for a thruster charge.

In the reverse follow-through configuration the primary charges are located behind the secondary charge. The additional advantages of the present multi-charge munition in a reverse follow-through configuration is that detonation of the primary charges thrusts the secondary towards the hole produced by the penetrators, thus lessening the need for a rearward auxilliary charge. The secondary charge can be designed to take advantage of the geometrically dispersed nature of the array of primary charges, and is therefore preferably located within a volume defined by the trajectories of the penetrators. The penetrators will therefore travel past the outside surface of the secondary charge to reach the target. The primary charges will preferably be arranged to produce convergent, and most preferably focussed, penetrators. The secondary charge will therefore preferably be tapered towards its forward end to take maximum advantage of the space available in the volume defined by the penetrator trajectories, and is most preferably conical. The general shape of a conical secondary charge design offers a relatively large surface at its rearwardly-facing end upon which the blast effects from the detonated primary charges can act to drive it into the borehole. The shape also offers lower aerodynamic drag than a cylindrical design, is drag-stabilised in flight and is less likely to be inadvertently blown back out of the borehole once emplaced.

The present multi-charge munition may comprise a demolition munition suitable for static positioning at a target, for example at a concrete ground target. Alternatively, it may preferably comprise an aerially-deliverable munition. One such preferred munition is a dispensable submunition suitable for dispensing from a multi-submunition dispenser. Dispensers of this type can be carried on aircraft and are typically designed for the multiple attack of airfield runway surfaces. Another preferred munition is an aerially-deliverable bomb, whose secondary charge contained within the body of the bomb will generally be very much larger than the secondary charge in a dispensable submunition and so will usually carry its primary charges in a follow-through configuration. The aerially-deliverable munition may be fitted will stabilising fins and it may be desirable in some cases to fit a flight-retarding device such as a parachute to assist in adjusting the speed and angle of attack of approach to the target.

When the multi-charge munition is provided as a aerially deliverable bomb, the bomb may be provided with its own guidance system, such as a laser guidance system, located in front of the bomb. In this case, the primary charges are preferably supported about the axis of target penetration between the guidance system and secondary charge in order to prevent aerodynamic interference of the guidance system by the primary charges. The guidance system preferably includes a plurality of longitudinal, most preferably equispaced canards extending radially from a body member, and it is preferred that the primary charges are located detonatable array such that their lines of trajectory pass between these canards so as to prevent the canards from impairing the penetration performance of the primary charges. For the reason, the number of canards and primary charges are ideally the same and conveniently this number is four.

The primary charges on the bomb, which are preferably housed protected from damage in their own aerodynamic-shaped shielding, may be of a size which dictates that the outside diameter of the shielding is greater than that of the bomb body containing the secondary charge. In this instance, the shielding is preferably contoured around the primary charges and the primary charges are preferably alignable at a first position one behind each of the canards. This permits the bomb to be carried between adjacent canards as close as possible to its associated airborne carrier to minimize aerodynamic drag. Once the bomb is dropped, the primary charges are preferably alignable at a second position between adjacent canard in readines for attacking a target. In order to effect such alignment, the primary charges and guidance system body member are preferably rotatable relative to one another about the axis of target penetration, at least to a limited extent sufficient to permit relative rotation of the primary charges from the first to the second position.

In a further embodiment of the present invention a multi-charge munition suitable for defeating both concrete and armoured targets or combinations of the two is provided in which the primary charges in the array are arranged laterally about the secondary charge to produce focussed penetrators, and the follow-through charge comprises a secondary hollow (preferably shaped), charge having a recessed forward face lined with a second hollow charge liner. The mass of the secondary charge will preferably be greater than that of each primary charge. In this arrangement the secondary charge is detonated such that its penetrator either leads or follows the penetrators from the primary charges or combines with them at some point inside or outside the target. The primary penetrators will preferably be optimised to disrupt and clear interfering material between the target and secondary charge, thereby enhancing the performance potential of the latter. In general the primary charge liners will produce high velocity jet penetrators from low density material (usually less than 5 $gm/cm^{-3}$) with conical liner apex angles of preferably between 20° and 60°. The secondary charge can be designed to form either a jet penetrator or non-stretching slug type penetrator from a liner of high density material (usually higher than 5 $gm/cm^{-3}$) such as copper. Liner apex angles within the secondary, hollow charge may therefore range from 20° to 120° or the liners may be of geometries similar to hemispherical caps (usually termed Misznay Shardin dishes). An advantageous feature of this embodiment where the primary charges are arranged laterally of the secondary charge is that the detonation of the array will in most cases result in increased confinement of the secondary charge which will lead to a net increase performance of the latter. A prerequisite for this embodiment therefore is that detonation of the primary and secondary charges must be essentially simultaneous.

BRIEF DESCRIPTION OF THE DRAWINGS

Embodiments of multi-charge munitions incorporating hole-boring charge assemblies in accordance with the present invention will now be described by way of example only with reference to the accompanying drawings in which FIGS. 12 and 13 illustrate the effect of the munition illustrated in FIG. 11 on a target.

DETAILED DISCUSSION OF PREFERRED EMBODIMENTS

Figure 1:
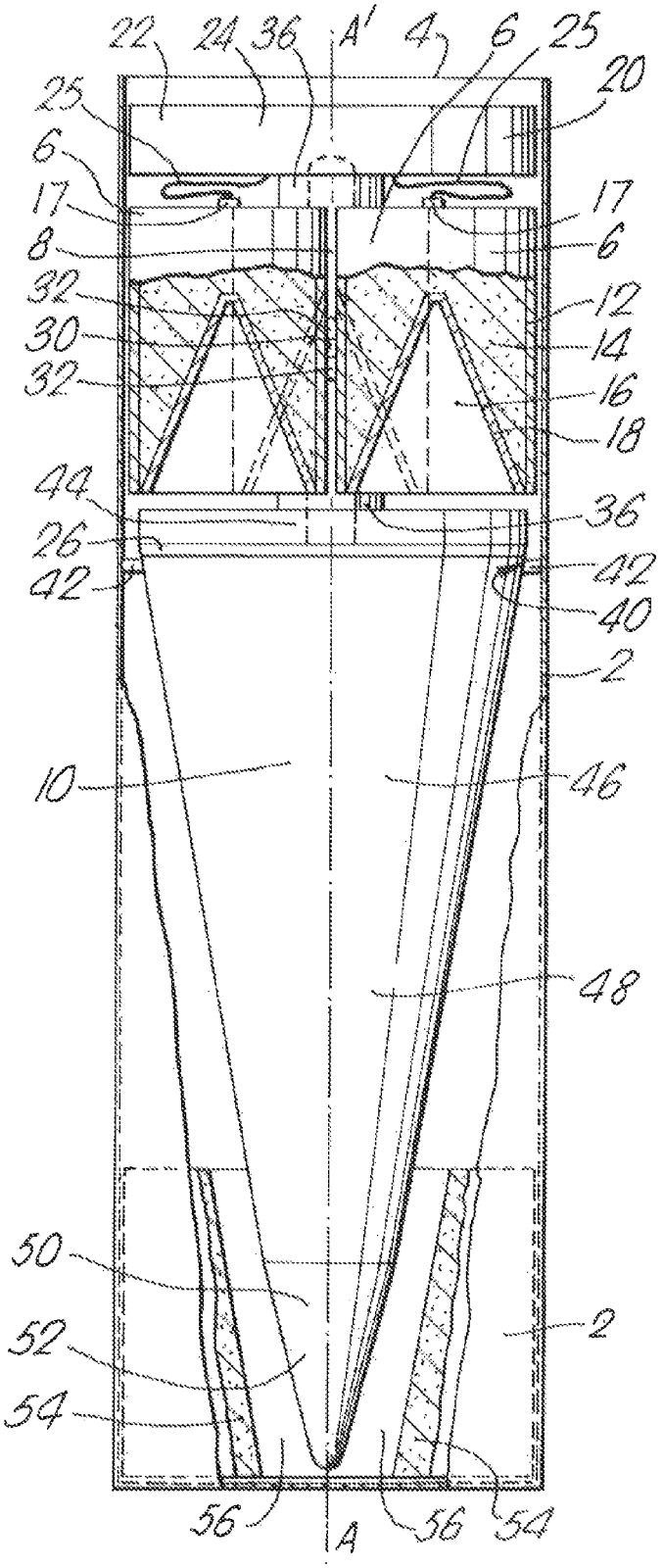
FIGS. 1 and 2 illustrate part sectional views taken along a fore-and-aft line of target penetration of a reverse follow-through sub-munition suitable for dispensing from a dispenser on an airborne carrier, having a conical follow-through charge, and three convergent hole-boring charges configured both before deployment (FIG. 1) and as deployed (FIG. 2)
Figure 2:
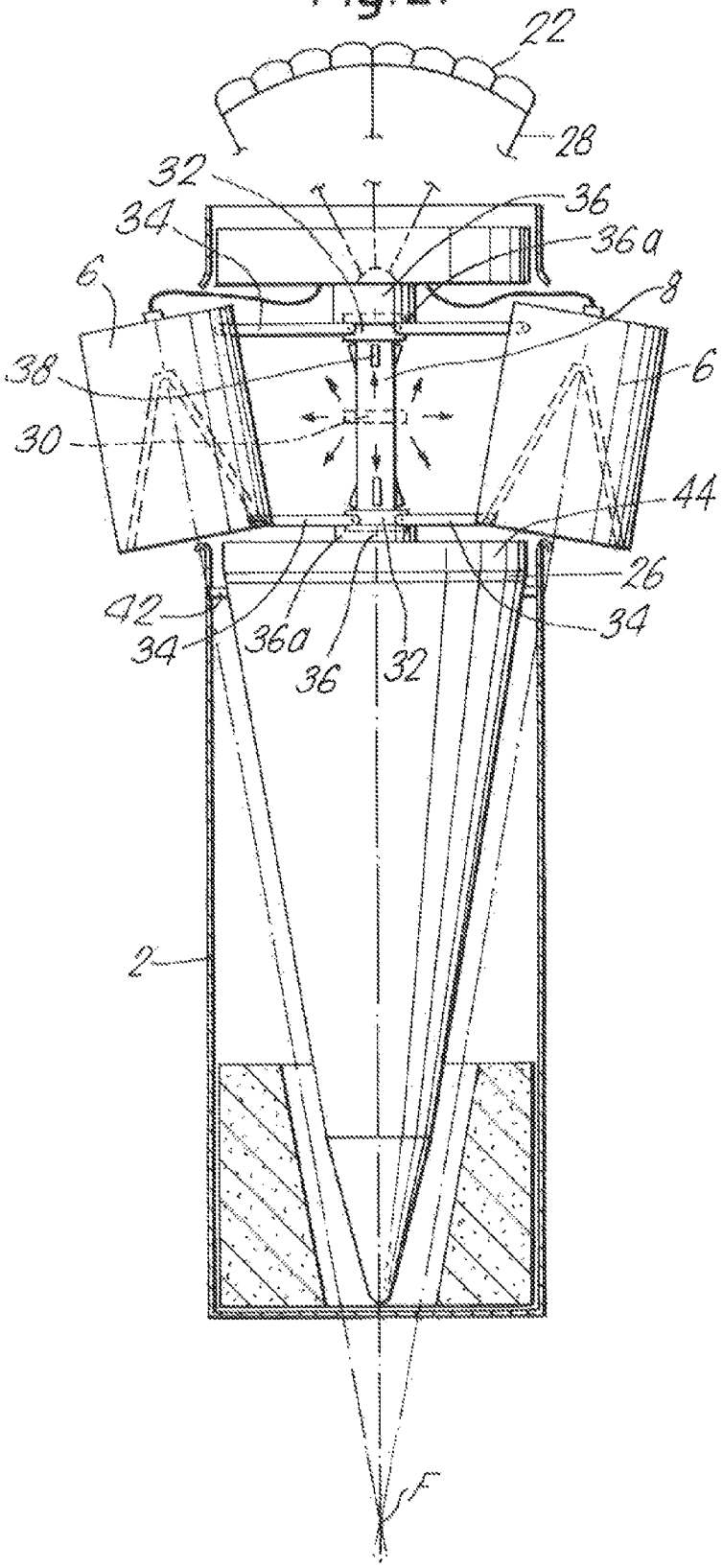

Referring first to the embodiment illustrated in FIGS. 1 and 2, there is illustrated in FIG. 1 a reverse follow-through submunition with a longitudinal fore-and-aft axis AA' consisting of a frangible cylindrical canister 2, with an open rear end 4, shown partly cut-away to reveal its contents. These contents consist primarily of three primary hollow charge munitions 6 positioned in a closely packed, parallel configuration about a support shaft 8 behind a conical encased secondary munition 10. The view of one of the primary munitions 6 is obscured by the other two and so its position is shown in broken outline. The two primary munitions 6 shown in solid relief are shown part-sectional, and each consists of a cylindrical casing 12 open at its forward end and containing a hole-boring shaped charge 14 of high explosive having a right-conical recess 16 in its forward face, and a rearward, axially-positioned detonator 17. The recess is lined with a low density liner 18 of non-explosive material, for example aluminium. The charge 14 of each primary munition is symmetrically disposed about an axis of symmetry. The axes of symmetry are configured in the arrangement illustrated in FIG. 1 approximately parallel to the line AA'.

The support shaft 8 is attached at its rear end to a flat cylindrical housing 20 disposed to the rear of the primary munitions 6, which houses a folded parachute 22 attached to the shaft and a safety and arming unit 24. Flexible electric firing leads 25 extend from the unit to the detonators 17 in the primary munitions 6. At its forward end the shaft 8 is attached to a circular protective support plate 26 which extends across the entire width of and is attached to the secondary munition 10.

Referring now also to FIG. 2 from which the primary munition 6 shown in broken outline in FIG. 1 has been omitted for reasons of clarity, after release of the reverse follow-through munition from its dispenser, (not shown), the parachute 22, which is attached to the shaft 8 by cord 28, is dispensed rearwards from the cylindrical housing 20 through the open rear end 4 to retard the free-fall of the reverse follow-through munition towards the target.

At some point between the launch of the reverse follow-through munition dispensed from its airborne carrier and its arrival at the target, an annular gas generator charge 30 located centrally about the support shaft 8 between two support rings 32 is ignited (for example, by a delayed signal received from the unit 24) and the combustion gases produced simultaneously urge the support rings slideably apart along the shaft. The movement of the rings 32 causes forward and rearward linkages 34 pivotally connected between the rings and the casings 12 of the primary munitions 6 to rotate outwards from their initial positions parallel with the shaft, and so urge the primary munitions outwards from the axis AA' until they collide with the walls of frangible canister 2. The force of the collision, which is augmented by the direct outward thrust of combustion gases from the gas generator charge 30, is sufficient to burst the canister 2 open at the regions of impact, allowing the primary munitions 6 to continue on their lateral trajectory from the axis AA'.

The rings 32 eventually collide and nest within the internal bases of cup-shaped stops 36 coaxially mounted on the shaft 8, which rings interact with the linkages 34 to arrest the primary munitions 6 at their required positions ready for detonation. Spring-loaded clips 38 emerge from the shaft 8 once the rings 32 have passed over them to lock the rings into positive engagement with the stops 36 and so prevent any further lateral movement of the primary munitions 6. The annular lips 36*a* of the cup-shaped stops 36 engage with the deployed linkages 34 to prevent any longitudinal or further rotational movement of the primary munitions 6. Thus during the flight of the reverse follow-through munition to its target, the shaft 8 supports the primary munitions 6 through the rings 32, stops 36 and linkages 34 and the secondary munition 10 through the protective support plate 26.

The secondary munition 10 is additionally suspended from the tapered inside support face 40 of an annular support 42 attached to the inside of the canister 2. An encased, annular auxilliary charge 44 is supported about the shaft 8 between the primary munitions 6 and the support plate 26. The secondary munition 10 is provided in two parts consisting of an encased rear portion 46 containing a main follow-through charge 48, and an encased nose portion 50 containing a secondary munition fuze 52. An annular primary munition fuze 54 is disposed within the frangible canister 2 about the nose portion 50, leaving a tapered, annular gap 56 between the two through which the axes of symmetry of the primary munitions 6 pass when deployed (see FIG. 2).

Once the reverse follow-through munition is deployed in the arrangement shown in FIG. 2, the primary munition fuze 54 and secondary munition fuze 52 are armed by the unit 24 in preparation for attacking a target. When the munition comes into close proximity to or contacts a target, the primary munition fuze 54 transmits a signal to the unit 24 which through the leads 25 and detonators 17 simultaneously detonates all three shaped charges 14 which, in turn, detonate the auxilliary charge 44 very shortly thereafter. The axes of symmetry of the deployed primary munitions 6 are focussed at a point F on the axis AA' a short distance in front of the primary munition fuze 54, and when the primary munitions are detonated the liners 18 are simultaneously collapsed and projected along these axes in the form of high speed penetrators. The conical secondary munition 10 is confined within a volume bounded by these axes, so that the penetrators travel towards the target without initiating the follow-through charge 48. The penetrators meets at the focal point F and coalesce into a single, coalesced penetrator which travels along the axis A'A and into the target. Ideally, the primary munition fuze 54 is arranged to detonate the primary munitions 6 when the follow-through munition strikes the target, such that the penetrators meet at the focal point F just below the surface of the target. The residual blast effects from the charges 14 and 44 strip away the shaft 8, canister 2 and primary fuze 54 from the secondary munition 10 which is protected from damage mainly by the support plate 26.

Figure 3:
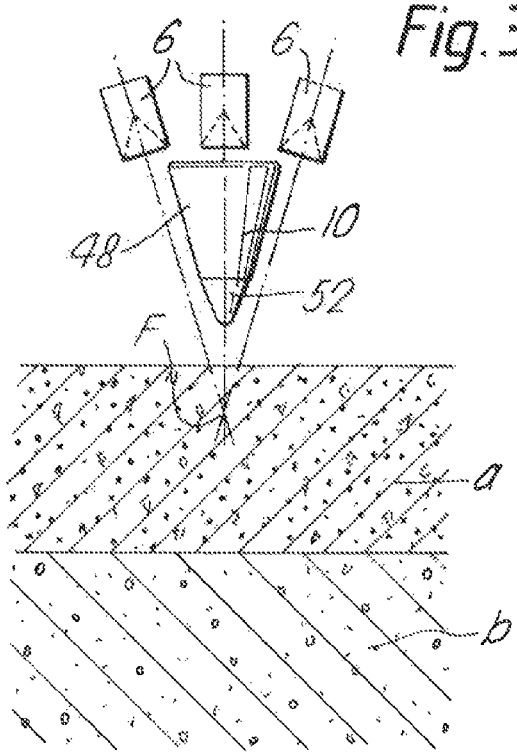
FIGS. 3 and 4 show schematically the process of emplacing the follow-through charge of FIGS. 1 and 2 in a concrete ground target of limited concrete thickness.
Figure 4:
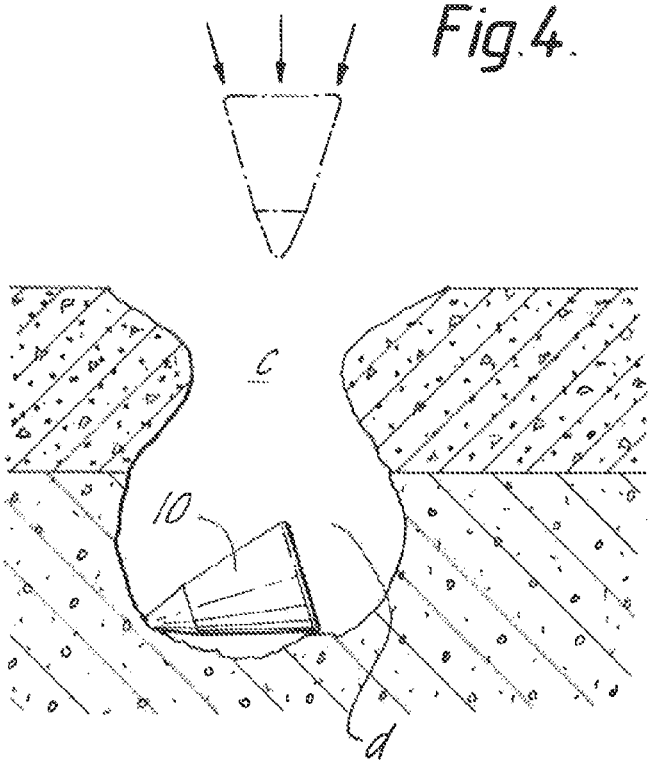

In FIGS. 3 and 4 there is shown the effect of the reverse follow-through munition on a concrete ground target (a) overlying a softer ground material (b) such as gravel or sand. The coalesced penetrator formed below the surface of the target bores a hole (c) which widens out into a shallow recess (d) in the underlying ground material (b). The secondary munition 10 is pushed towards and into the hole at a relatively very much slower velocity than that of the penetrators, by the combined blast effects of the rearwardly-positioned shaped charges 14 and auxilliary charge 44. The auxilliary charge 44 is not essential and may be dispensed with altogether if the blast effects from the primary munitions 6 are of sufficient magnitude to emplace the secondary munition 10. The size of the hole-boring charges 14 within the primary munitions 6 are selected to be large enough to bore a hole of sufficient width to allow emplacement of the secondary munition 10 through the hole (c) and into the recess (d). The shock effects produced by the combined blast primes the secondary fuze 52 which detonates the much larger follow-through charge 48 soon after its emplacment in the recess (d) to produce a massive cratering effect on the concrete target.

It has been found that, against a 0.3 m thick concrete vehicle-supporting ground target (eg airfield runway), a triple focussed array of identical shaped charges each having a diameter of 85 mm and conical aluminium liner of 45° apex angle and arranged on a pitch circle diameter of 200 mm with their axes inclined at 8°56' to a fore-and-aft line of target penetration, such that the forward faces of the charges are located at a distance of 425 mm above the surface of the target and the axes are focussed at a point 200 mm below the surface, will produce a bore-hole of similar throat dimension and penetration depth as a 180 mm diameter unitary shaped charge with an 85° conical aluminium liner and an all-up mass of twice that of the triple array.

Figure 5:
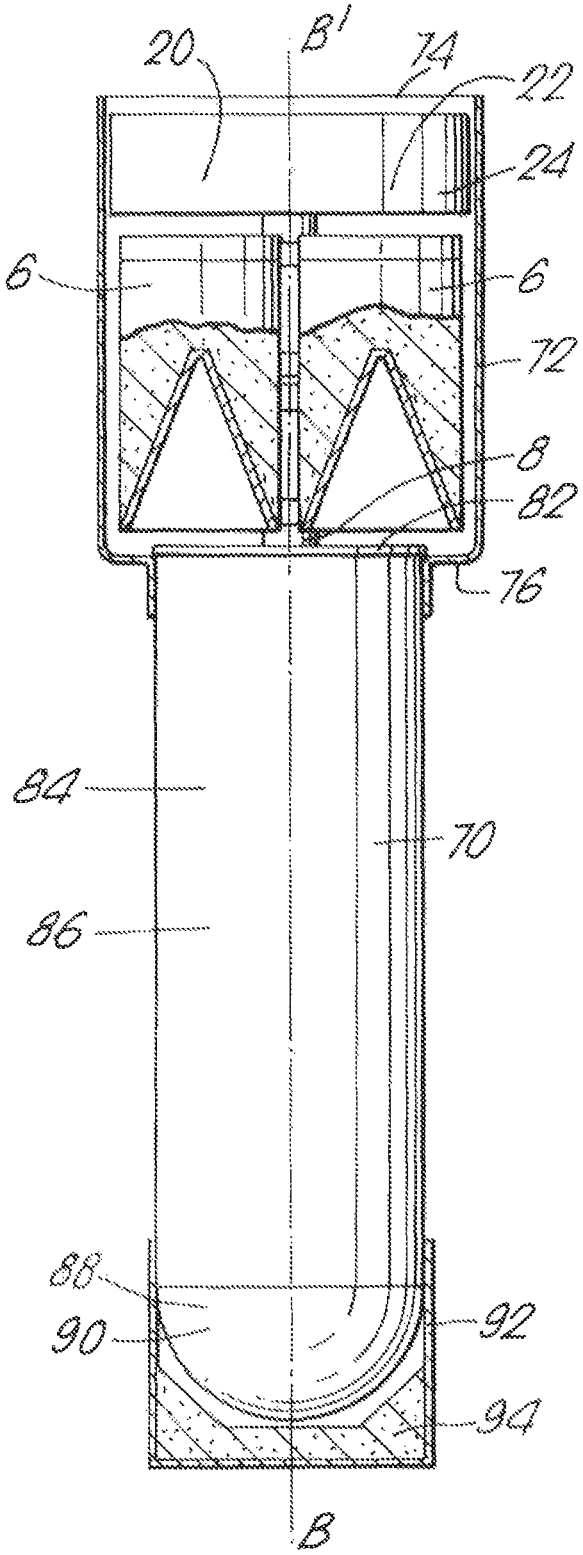
FIGS. 5 and 6 illustrate similar views to those illustrated in FIGS. 1 and 2 of a reverse follow-through munition having a cylindrical follow-through charge and a parallel array of four hole-boring charges, FIG. 7 provides a schematic representation of the effect of four non-coalesced hollow charge penetrators passing concurrently through a concrete target.
Figure 6:
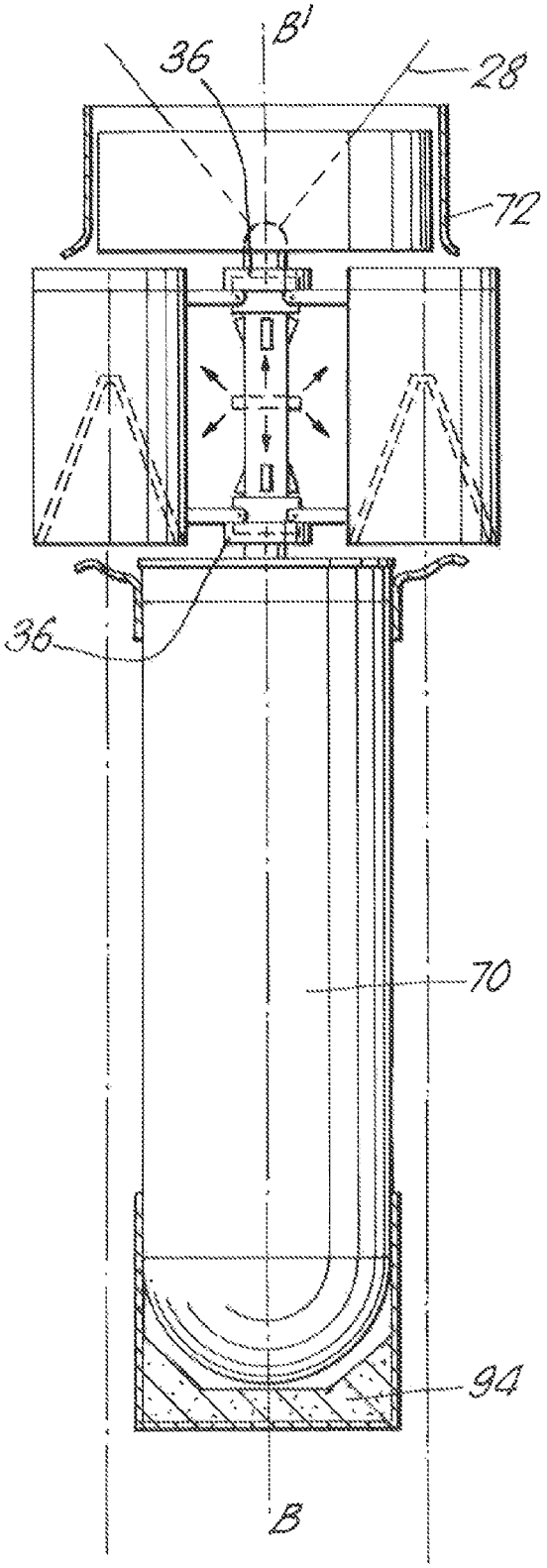

A similar reverse follow-through sub-munition to that illustrated in FIGS. 1 and 2 is illustrated as a second embodiment of this invention in FIGS. 5 and 6, which is again designed for dispensing from an airborne carrier. In this second embodiment, four of the primary munitions 6 (of which only two are shown) are configured in a clustered, closely packed equispaced array (FIG. 5) and in a deployed array (FIG. 6) to the rear of an elongate cylindrical secondary munition 70 having a fore-and-aft axis BB'. Before deployment, the primary munitions 6 and rearwardly disposed housing 20 for the parachute 22 and the safety and arming unit 24 are both enclosed in a frangible cylindrical aft canister 72 (see FIG. 7) which has an open rear end 74 and a forward end 76 which is swaged onto the rear end of the secondary munition 70. The secondary munition 70 is provided in two parts; an encased rear portion 84 containing a main follow-through, high explosive charge 86, and a forward hemispherical nose portion 88 housing a secondary fuze 90 for the follow-through charge 86. The rear end of the secondary munition 10 is attached to a protective support plate 82 which serves to protect the munition from the blast damage caused by the primary munitions 6 and which in turn is attached to the shaft 8. A frangible nose cap 92 protects the secondary fuze and houses a primary fuze 94 for the primary munitions 6.

The parachute 22 and primary munitions 6 are deployed in the same manner as that described with reference to FIGS. 1 and 2 except that once the primary munitions burst through the aft canister 72 to their deployed positions, their axes of symmetry lie parallel to and equidistant from the axis BB' in a square configuration. Thus, when these primary munitions 6 are simultaneously detonated, from signals received from the primary fuze 94 as the reverse follow-through sub-munition approaches or strikes a target, the four liners 18 are collapsed into penetrators which are each projected in a forward direction just clear of the cylindrical surface of the secondary munition 70 to strike the target concurrently but at separate, closely spaced locations.

Figure 7:
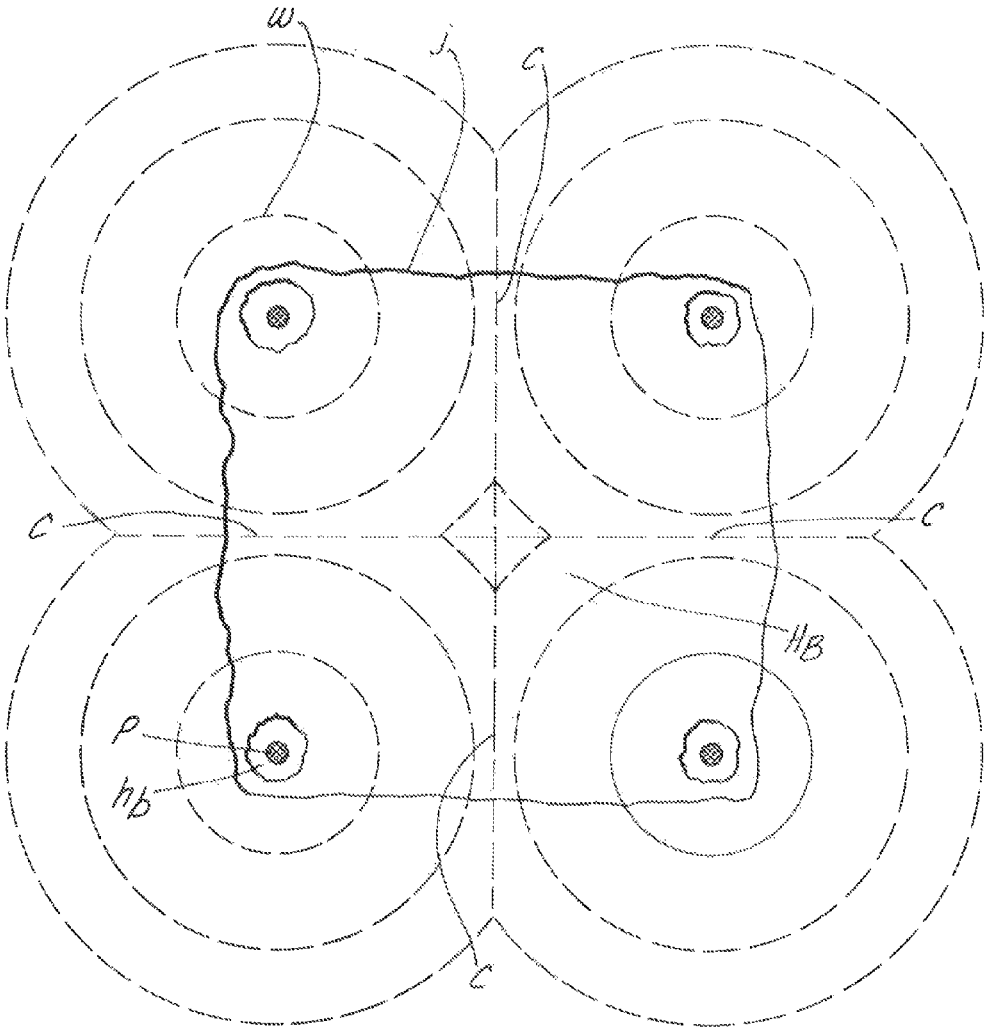

The effect of these separate penetrators penetrating a hard, brittle target material such as concrete is shown in FIG. 7, which is a schematic representation of a cross-section through the target material taken laterally of the line of flight of the penetrators at the instant of their passage through the target. The penetrators (p) bore narrow, inwardly-tapered holes ($h_b$) into the target material. The process of penetration generates shock waves (w) in the target material which radiate outwards from the holes ($h_b$). Since they are generated concurrently, the shock waves derived from adjacent penetrators collide along planes (represented end-on by lines (c) which extend into the target material and run parallel to and between the paths of the penetrators. Collision and reflection of the shock waves creates regions of intense compression along these planes, causing material in the vicinity of these regions to fail. Upon subsequent relaxation following compression, a large volume of target material surrounding the holes ($h_b$) is ruptured. Gases generated during penetration contribute to the ejection of ruptured material outwards from the surface of the target to leave behind a large squarish hole ($H_b$) bounded by the jagged line (j).

The hole ($H_b$) extends for most of the depth of the holes ($h_b$) bored initially by the individual penetrators, and its volume is generally considerably greater than that produced by a single shaped charge containing the same total mass of explosive as the four primary munitions 6. Since the position of the array of primary munitions 6 at detonation approximately defines the corner locations hence lateral shape and dimensions of the hole ($H_b$), these positions in turn approximately define the maximum diameter of secondary munition 70 which can be driven into the hole.

It has been found that a quadruple parallel array of identical shaped charges, each having a diameter of 85 mm and a conical aluminium liner of 45° apex angle, set on a pitch circle diameter of 300 mm and arranged such that the forward faces of the charges are separated from the surface of a 0.3 m thick concrete runway ground target by a distance of 510 mm, will produce a borehole of similar throat dimensions and penetration depth as a unitary shaped charge with an 85° conical aluminium liner and an all-up mass of 1.8 times that of the quadruple array.

It will be seen from FIG. 7 that a similar effect will be obtained from primary munitions 6 whose axes of symmetry are slightly divergent or slightly convergent as they extend in a forward direction, because with these alternative arrangments the penetrators will also penetrate the target at separate but closely spaced locations. A slightly divergent array of primary munitions 6 will tend to generate a shorter, wider hole in a concrete target than that generated by a parallel array whereas a slightly convergent array will tend to produce a deeper, narrower, and slightly tapered hole. Unless the primary munitions are forwardly-focussed, a minimum of three primary munitions are required in order to produce the hole-boring effect illustrated in FIG. 7.

The secondary munition 70 is thrust into the hole ($H_B$) by the combined blast effect from the detonated primary munitions 6. The shock effects produced by the blast primes the secondary fuze 90 which detonates the follow-through charge 86 soon after emplacement.

Figure 8:
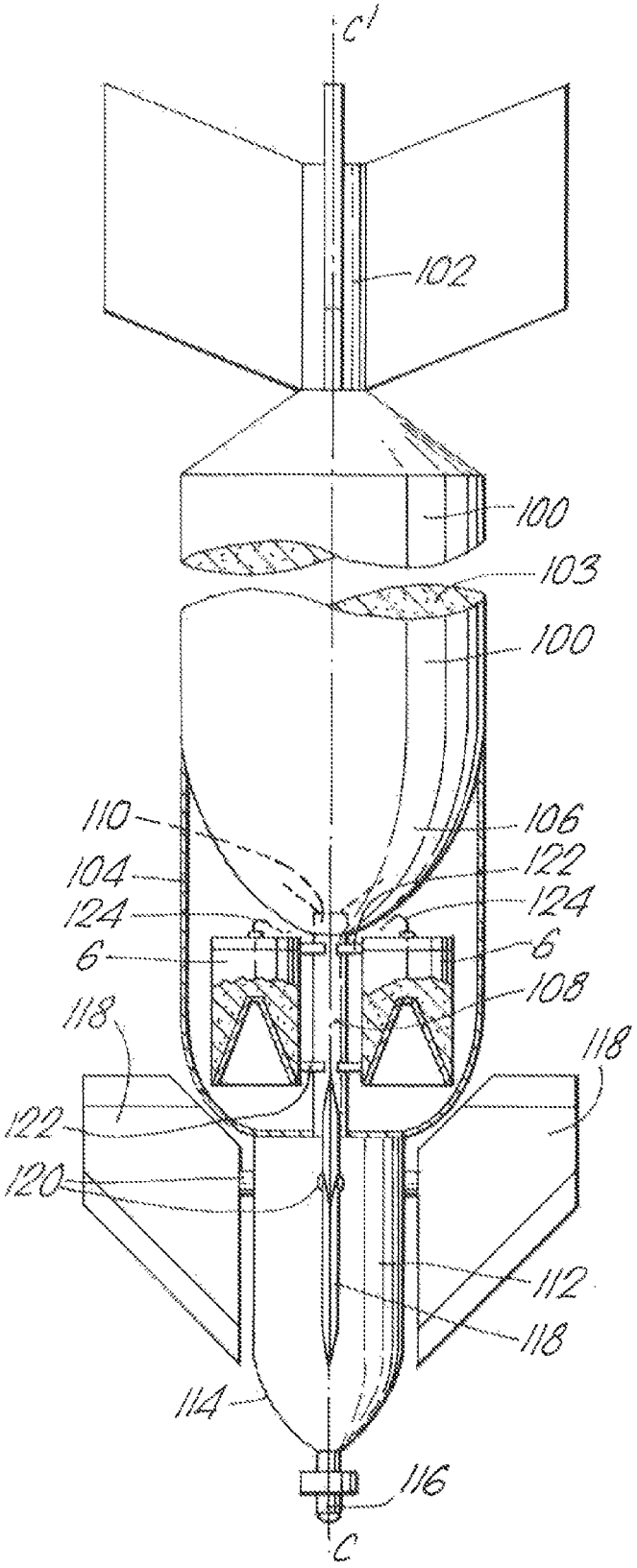
FIGS. 8 to 10 are part-sectioned, schematic views of follow-through aerial bombs having hole-boring charges arranged in parallel, divergent, and convergent arrays, respectively.
Figure 9:
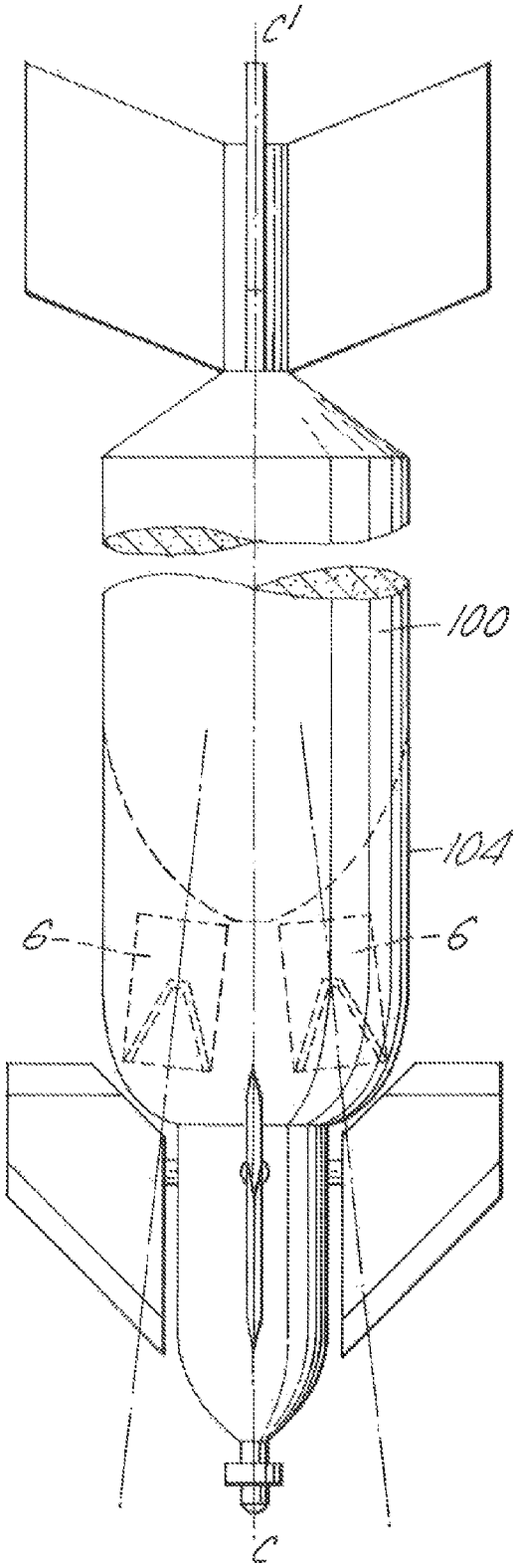
Figure 10:
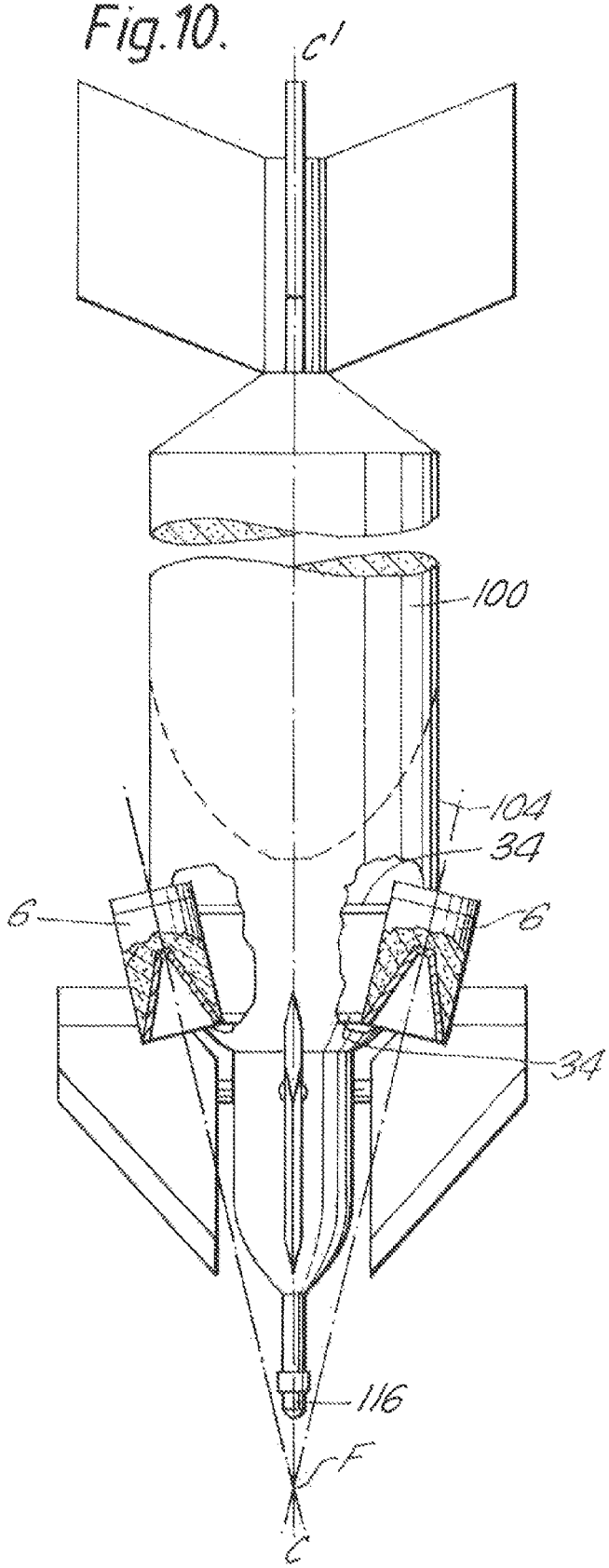

Referring next to FIGS. 8 to 10, in each Figure there is illustrated an elongate bomb 100 having a tail fin unit 102, and a fore-and-aft axis of symmetry CC'. The bomb 100 contains a charge 103 of high explosive. An aerodynamically-shaped cowling 104 (shown sectioned in FIG. 8 to reveal its contents) is fitted over the nose section 106 of the bomb 100. A central spigot 108 located within the cowling 104 is screwed into the nose bung 110 of the bomb 100. Extending forwards from the cowling 104 is a cylindrical housing 112 having located axially on its ogival nose portion 114 a sensor 116, for example a laser sensor, which incorporates a contact fuze. Four equispaced longitudinal canards 118 radiate outwards from the housing 112 along its length. The canards 118 are supported on bearings 120 which allow the canards a limited degree of rotation about axes radiating transversely from the axis CC'. The degree of rotation of the canards, which affects the trajectory of the bomb 100 as it falls through the air, is controlled by a motor (not shown) located within the housing 112. The motor is in turn controlled by a guidance system (not shown), for example a laser guidance system.

In each of the bombs illustrated in FIGS. 8 to 10, supported by the spigot 108 are four of the primary munitions 6 located each at separate, equispaced locations within the cowling 104 between adjacent canards 118. In the embodiment illustrated in FIG. 10, the cowling 104 is frangible and the primary munitions 6 are shown deployed through the walls of the cowling on linkages 34 in the manner described above with reference to FIGS. 1, 2, 5 and 6 with the spigot 108 acting as the support shaft. Once deployed, the primary munitions 6 are configured in a convergent array with their axes of symmetry focussed at a point F on the axis CC' forward of the sensor 116. In FIGS. 8 and 9, the primary munitions 6 are mounted in fixed positions within the cowling 104, on fixed support webs 122 radiating outwards from the spigot 108, thus obviating the need for a deployment mechanism and reducing the exposure of the primary munitions to damage whilst the bomb is in flight. In FIG. 8, the primary munitions 6 are configured in a parallel array with respect to the axis CC', whereas in FIG. 9 the primary munitions are configured in a slightly divergent array.

Each primary munitions 6 is linked to the contact fuze within the sensor 116 by a flexible electric firing lead 124. When the sensor strikes a target, the fuze causes the primary munitions 6 to detonate immediately and simultaneously. If the target is a hard, brittle material such as concrete, the detonated primary munitions 6 will bore a hole in the target in the manner described above with reference to FIG. 7 if the array is parallel or divergent (see FIGS. 8 and 9) and with reference to FIGS. 3 and 4 if the array if focussed (see FIG. 12) and the target of finite thickness, to allow the following bomb 100 to at least partly enter the target under the influence of its residual forward inertia, before being detonated itself by the use of an appropriate impact or delay fuze (not shown) incorporated within the bomb. The mass of explosive in the bomb 100 will typically be greater than 5 times, more typically greater than 10 times, the total mass of explosive in the primary charges 6, so that full emplacement of the bomb within the hole may not be easily accomplished. However, the formation of the holes will at very least help to overcome the problem of the bomb bouncing off a hard target such as concrete before exploding, a problem which is greatly increased if the bomb is flight-retarded (by, for example, a parachute) so reducing its forward inertia.

Figure 11:
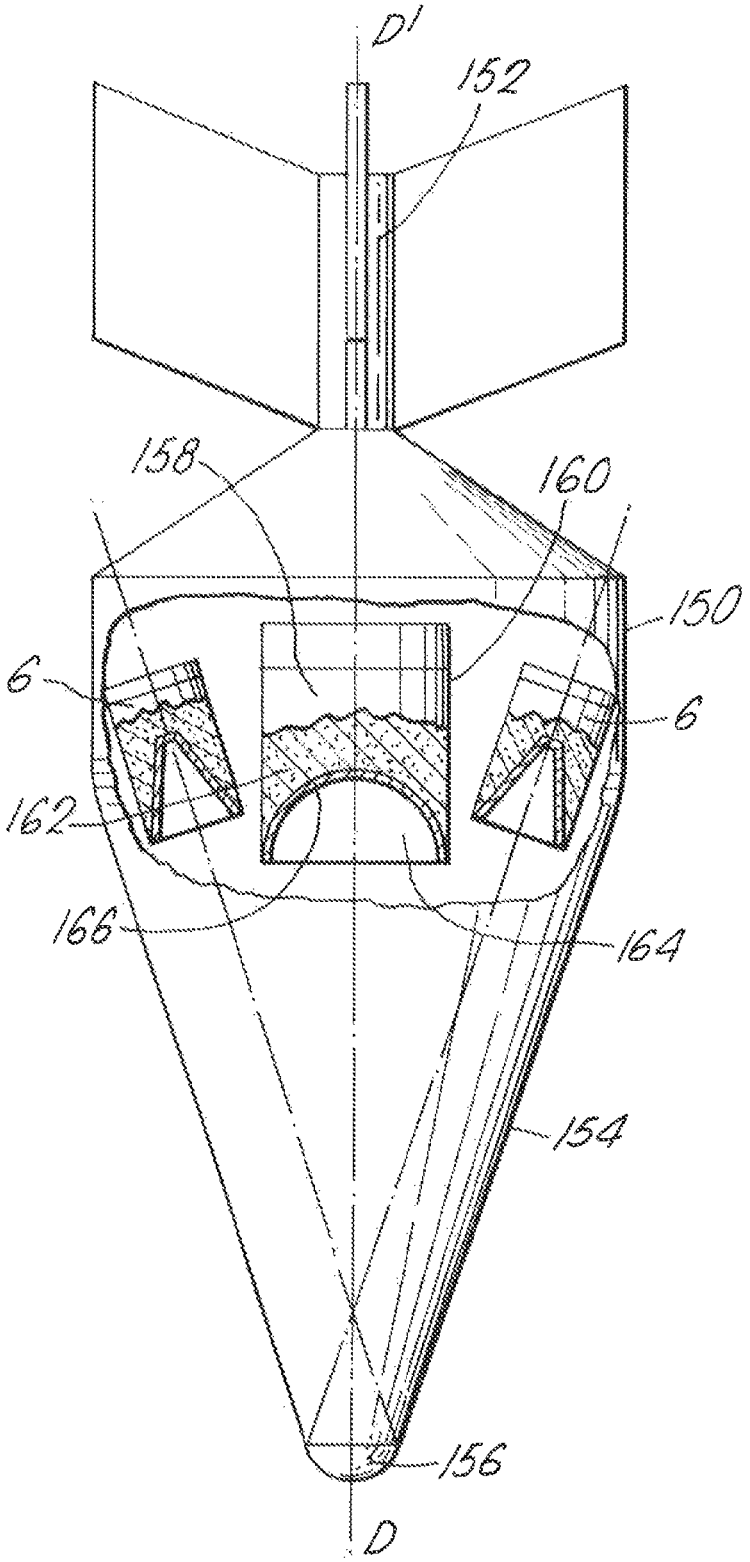
FIG. 11 is a part-sectioned, schematic view of a multi-charge munition in which the follow-through charge comprises a hollow charge.

Referring next to FIGS. 11 to 13, there is illustrated in FIG. 11 a projectile having a hollow cylindrical body 150 attached to a tail fin unit 152. The body has a hollow conical nose portion 154 within which is located a fuze 156. The body 150 (which is shown partly cut away to reveal its contents) houses an equispaced array of four of the shaped charge primary munitions 6 (only two are shown for convenience) disposed laterally of the longitudinal fore-and-aft axis DD' of the projectile about a cylindrical secondary munition 158. The axes of symmetry of the primary charges are focussed on the longitudinal axis DD' at a point F just behind the fuze 156.

The secondary munition 158, which is shown partly sectioned, is symmetrically disposed about the longitudinal axis. It consists of a cylindrical casing 160 open at its forward end, containing a hollow charge 162 of high explosive having a hemispherical recess 164 in its forward face which is lined with a mild steel Misznay-Shardin plate 166. The mass of the charge 162 is typically from 2 to 10 times that of the individual charges 14 within the primary munitions 6.

The use of the projectile illustrated in FIG. 11 against a steel target (t) faced with a layer (r) of earth or concrete is illustrated in FIGS. 12 and 13. As the projectile strikes the layer (r), the fuze 156 sends a signal to the munitions 6 and 158 and detonates all the charges simultaneously. The four aluminium liners 18 each collapse into high speed jet penetrators which meet and coalesce at the focal point F just above the surface of the layer (r) and form a wide borehole therein. However, their energy is largely dissipated by the time the coalesced jet penetrator meets the steel target (t) and so have little effect on it. The plate 166 forms into a slower-moving slug (s) which follows the coalesced jet penetrator and so passes through the wide borehole to make direct contact with the steel target. By avoiding collision with the earth or concrete facing material, the penetration efficiency of the slug against the steel target is not impaired.

Figure 14:
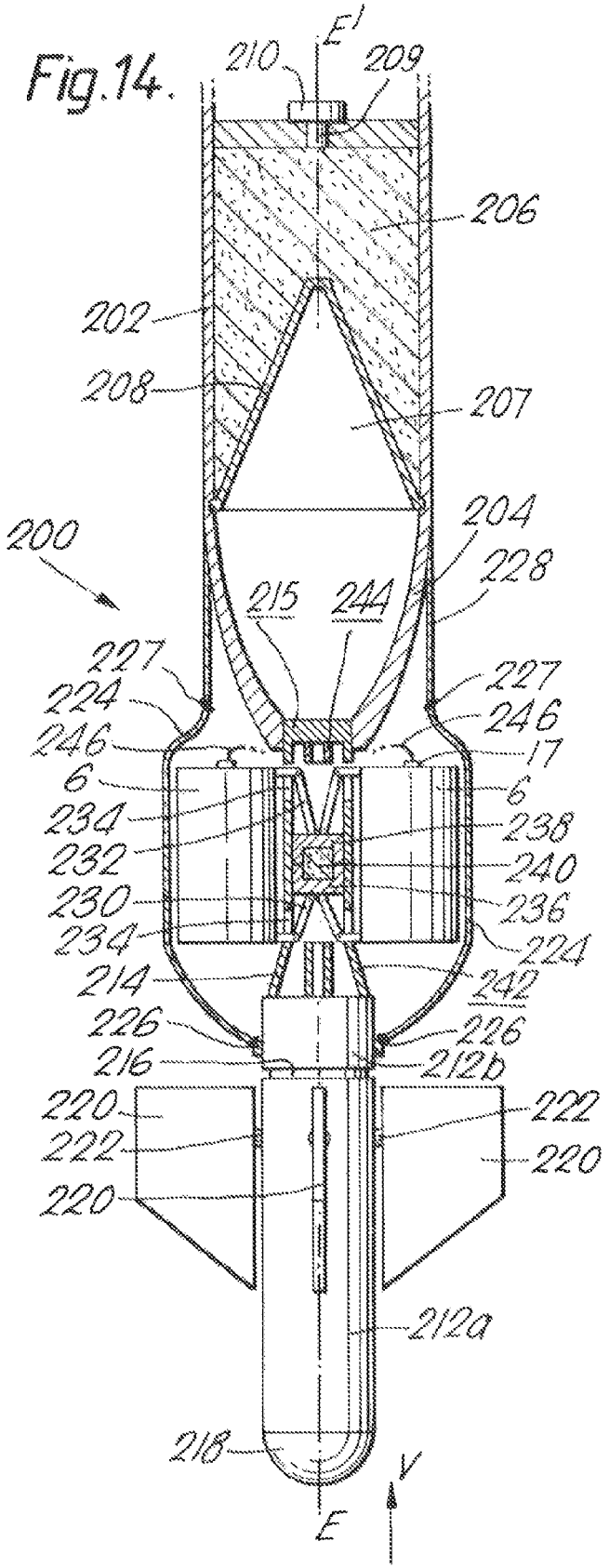
FIGS. 14 and 16 are partly-sectioned views of the forward part of follow-through aerial bomb containing a hollow explosive charge, and having associated therewith four convergent hole-boring charges configuration both before deployment (FIG. 14) and as deployed (FIG. 15)
Figure 15:
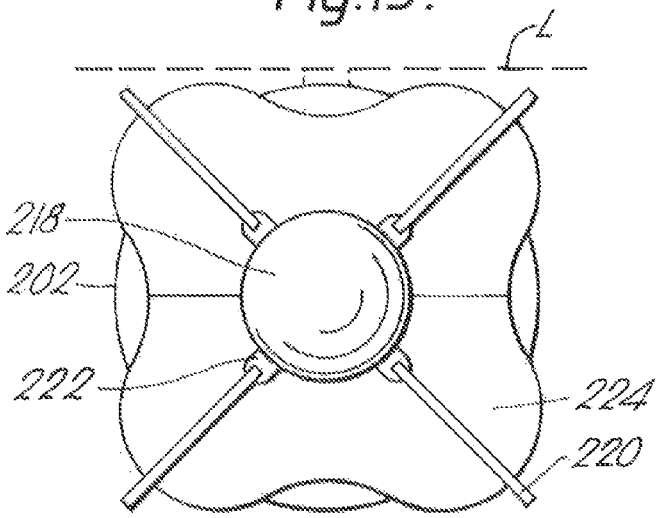
FIG. 15 is a view taken in direction V of the bomb illustrated in FIG. 14.

Referring lastly to FIGS. 14 to 17, there is illustrated in FIGS. 14 and 15 the forward section of an aerially-deliverable bomb 200 having a fore-and-aft axis EE'. The bomb has a generally cylindrical bomb body 202 having a thickened, ogival nose section 204. The bomb body 202 contains a shaped main charge 206 of high explosive with a full diameter conical liner 208 of (for example) copper or aluminium which lines its forward recessed face 207. The main charge 206 has a detonator 209 axially located at the rear of the charge. A delay fuze 210 is colocated with and linked to the detonator 209.

Forward of the nose section 204 is located a cylindrical housing 212 supported by a tubular support member 214 extending between the housing and the nose section. The housing 212 and support member 214 are both coaxially located about the common axis EE'. The closed rear end 215 of the support member 214 is screwed into the nose section 204 and acts as a nose plug for the bomb body 202.

The housing 212 is divided into a fixed rearward housing **212*b* connected by a limited rotation bearing 216 to a rotatable housing 212*a*. At its front end, the forward housing 212*a* carries a sensor 218, for example a laser sensor, which incorporates a contact fuze. Four equispaced longitudinal canards 220 radiate outwards from the housing 212*a* along its length. The canards 220 are supported on bearings 222 which allow the canards a limited degree of rotation about axes radiating transversely from the axis EE'. The degree of rotation of the canards 220 is controlled by a motor (not shown) located within the forward housing 212*a***. The motor is in turn controlled by a guidance system (not shown), for example a laser guidance system.

The rearward housing **212*b* supports four equispaced, petalled bulbous cowlings 224 independently pivotable on hinges 226 attached to the rearward housing. Each cowling 224 houses one of the primary munitions 6. The cowlings 224 extend radially beyond the outside diameter of the bomb body 202, but are encompassed by the outside diameter of the array of canards 220 as can be seen from FIG. 15. At their rearward ends, the cowlings 224 are connected by a rupturable seal 227 to a tubular shell 228 fitted over the nose section 204 which prevents the aerodynamic forces acting on the cowlings when the bomb is in flight from rotating the cowlings inwards about the hinges 226** towards the axis EE'.

Each of the equispaced primary munitions 6 housed within its associated cowling 224 is supported fore and aft by fore and aft articulated linkages 230 and 232 respectively which extend through longitudinal slots 234 in the tubular support member 214. The likages 230 and 232, which are shown folded in FIG. 14, are linked to fore and aft pistons 236 and 238 respectively which are slideably located within the tubular support member 214. The pistons 236 and 238 contact one another and have recessed opposing faces which together enclose a gas generator charge 240. Fore and aft tubular stops 242 and 244 extend within the support member 214 towards the fore and aft pistons 236 and 238 respectively.

The sensor 218 is electrically connected to the gas generator charge 240, and to the delay fuze 210. Four flexible, electric firing leads 246 extend from the fuze within the sensor 218 one to each of the detonators 17 in the primary munitions 6.

The forward housing **212*a* is, as shown in FIGS. 14 and 15, initially positioned with respect to the rearward housing 212*b* such that each canard 220 lies directly in front of one of the cowlings 224. This ensures that the bomb 200 can be supported between adjacent canard/cowling pairs under a launch platform L (such as an aircraft wing) with a minimum of clearance between the platform and bomb body 202**, thus minimising the aerodynamic drag of the bomb on the carrier.

Once the bomb 200 has been dropped from its carrier, the forward housing **212*a* is rotated on the bearing 216 a one-eighth turn (45°) to a new fixed position at which the cowlings 224, hence the primary munitions 6, are located in the quadrant spaces between the canards 220**.

As the bomb 200 approaches its target towards the end of it guided flight path, a signal is transmitted from the sensor 218 to the ignite the gas generator charge 240. The gas pressure generated by the ignited gas generator charge 240 pushes the two pistons 236 and 238 apart within the support member 214, causing the articulated likages 230 and 232 to unfold. This in turn pushes the four primary munitions 6 outwards against the cowlings 224. The outward forces acting on the cowlings 224 ruptures the seal 227 and causes the cowlings to pivot outwards from the shell 228 about their respective hinges 226. The axial motion of the pistons 236 and 238 is eventually arrested by the stops 242 and 244 before the pistons reach positions at which pressure between them can exhaust through the slots 234. The abutment of the articulated linkages 230 and 232 against the stops 242 and 244 respectively and against the ends of the slots 234 prevent further movement of the primary munitions 6. The primary munitions 6 are arrested in a focussed array illustrated in FIG. 16, in which their axes of symmetry are focussed at a point F on axis EE' forward of the sensor 218. Spring-loaded retaining clips 248 emerge from the pistons 236 and 238 to engage with the slots 234 and lock the primary munitions 6 in their focussed array positions.

Figure 16:
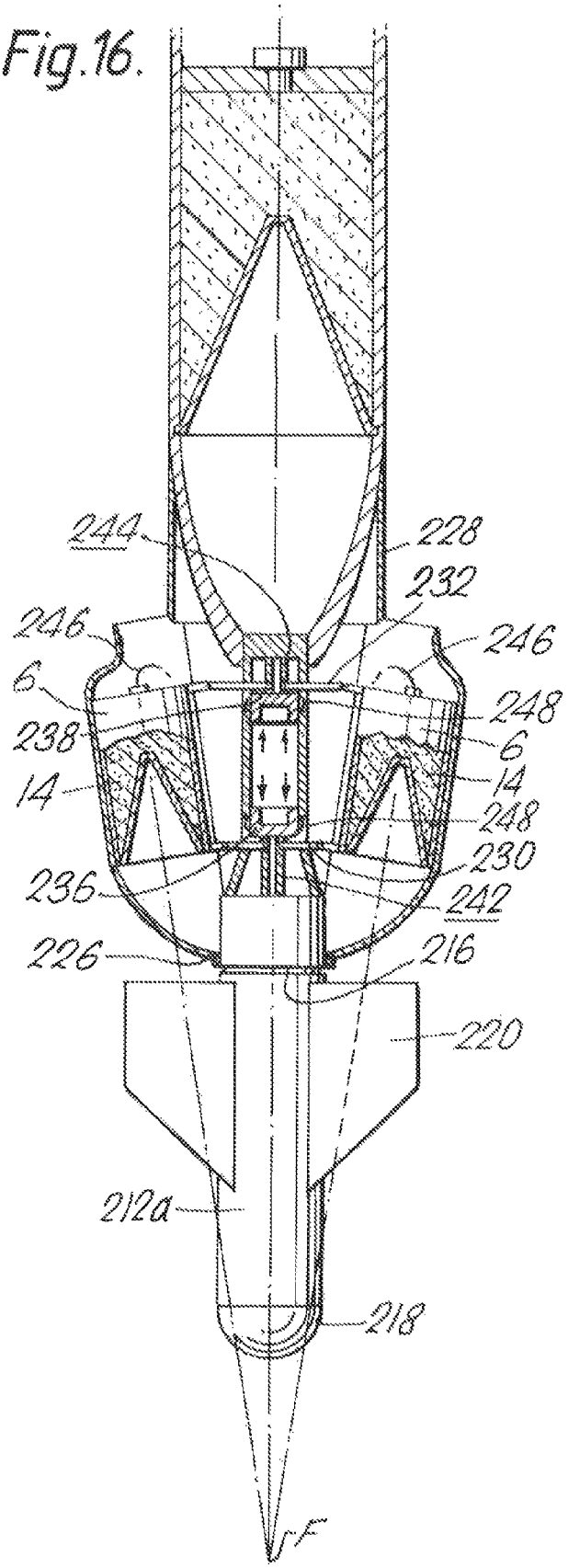

With the forward housing 212*a* and primary munitions 6 deployed in their respective positions shown in FIG. 16, the bomb 200 continues on the last part of its flight until the sensor 218 eventual strikes the target. On impact with the target, a signal is transmitted from the sensor 218 to the delay fuze 210 and to all four detonators 17 on the primary munitions 6, thereby causing immediate and simultaneous detonation of the primary munitions. The jet penetrators projected concurrently from the detonated primary munitions 6 follow lines of trajectory which pass between the canards 220 and meet at the focal point F in front of the sensor 218. This determines that the penetrators together form into a single coalesced jet penetrator at a point below the surface of the target.

Figure 17:
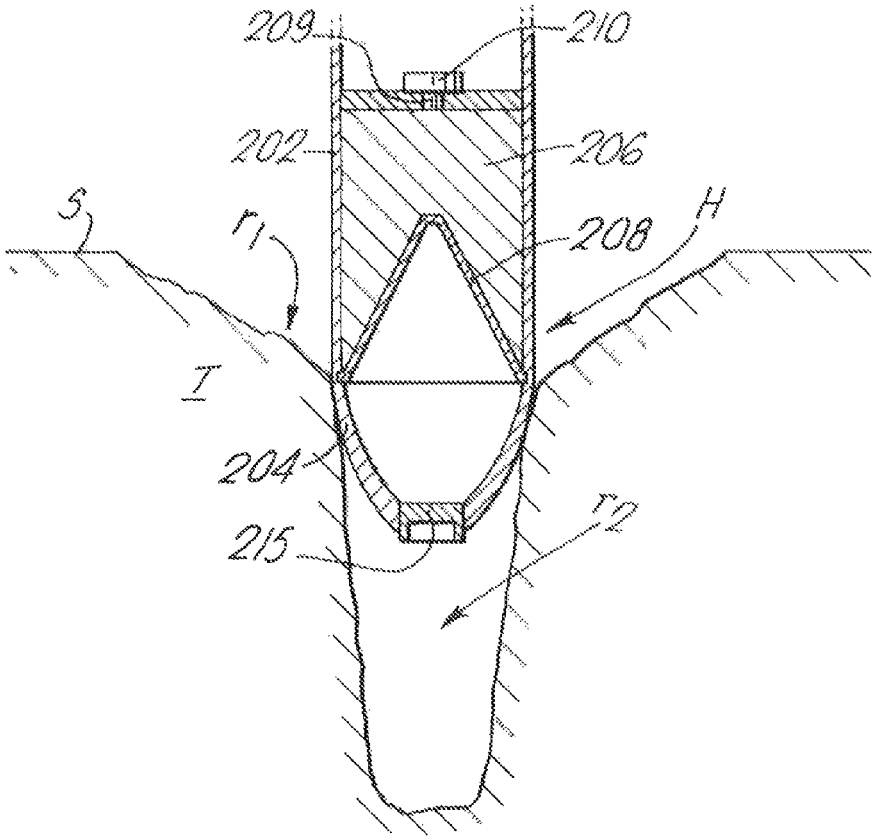
FIG. 17 is a schematic representation of the bomb of FIGS. 14-16 emplaced within a thick concrete target.

If the target is a hard, brittle material such as concrete of considerable depth, then the jet penetrators will typically produce a funnel-shaped, approximately axisymmetric hole H in the surface S of the target T, as is shown in FIG. 17. This hole is generally considerably wider than that which can be produced by a single charge, of the same total explosive mass as that the four primary munition 6, capable of boring a hole to the same depth. The detonation of the primary submunitions 6 destroys the forward components of the bomb, but the bomb body 202 and its contents remain intact due to the thickness of the nose section 204 and nose plug 215. The forward inertia of the remaining bomb, which may be augmented by a rearward booster charge (not shown), carries the bomb through the large diameter, shallow scabbed region ($r_1$) of the hole produced at the surface of the target until the ogival nose section 204 lodges in the deep tapered inner region ($r_2$) of the hole produced by the coalsced jet. This avoids the need for high bomb velocity in order to thrust the bomb into the target before main charge detonation. As a consequence, the deceleration forces acting on the bomb when it collides with the target are relatively mild, so reducing the probability of damage or disturbance to the main shaped charge 206 and its associated components.

Once lodged in the hole, the delay fuze 210 initiates detonation of the main charge 206 through the detonator 209. The acute taper of the inner region ($r_2$) of the hole provides an ideal hole shape to ensure that the bomb lodges a sufficient distance above the bottom of the hole to provide adequate standoff for the collapsing conical liner 208 to form into an effective jet penetrator capable of penetrating a considerable distance into the target. Subsequent damage to the target is caused by the synergistic effect of shaped charge jet pentration produced by the collapsed liner 208 followed by axial pressure applied through the penetration hole by the detonation products of the main charge 206.

The delay fuze 210 may alternatively be set to detonate the main charge 206 just before the bomb body 202 is arrested by collision with the tapered inner region ($r_2$) of the hole. This further reduces the probability of damage or disturbance to the main charge 206 before it is detonated.

The invention claimed is:

1. Multi-charge munition for attacking a target, comprising:

a cratering secondary charge of explosive disposed on a fore-and-aft line of target penetration, a detonable array of at least two hollow primary charges of explosive supported laterally about the line of target penetration, said array located behind said secondary charge, each primary charge having a recessed forward face, a liner of non-explosive material lining said forward face, and comprising a means, when detonated in the array, for projecting a penetrator derived from the liner along a line of trajectory extending forwards of the secondary charge and for propelling said secondary charge forward along said line of target penetration, a fuze system for initiating detonation of the array of primary charges and said secondary charge in sequence, and a primary detonation means, responsive to said fuze system, for detonating the primary charges in the array in a temporal relationship with respect to one another such that the penetrators are projected forwards towards the target concurrently.

2. Munition according to claim 1 wherein the primary charges in the detonatable array are all identical.

3. Munition according to claim 1 wherein the primary charges in the detonatable array lie in a plane normal to the line of target penetration.

4. Munition according claim 1 wherein the primary detonation means is arranged to detonate all the primary charges substantially simultaneously.

5. Munition according to claim 1 wherein the centre of gravity of each primary charge in the detonatable array is located within a pitch circle diameter of less than 6 primary charge widths.

6. Munition according to claim 1 wherein the primary charges are geometrically supported in the array such that the lines of trajectory independently lie at angles of from 0° to 30° to lines parallel to the line of target penetration.

7. Munition according to claim 1 wherein the primary charges are geometrically supported in the array such that the lines of trajectory converge towards one another forward of the array.

8. Munition according to claim 7 wherein the lines of trajectory are substantially focussed at a focal point located forwards of the secondary charge.

9. Munition according to claim 8 wherein the focal point is located at a distance of from 2 to 20 liner diameters from each of the forward faces.

10. Munition according to claim 8 wherein the focal point is substantially the same distance from each primary charge and that the primary detonation means is arranged to detonate all the primary charges substantially simultaneously.

11. Munition according to claim 8 wherein the fuze system includes primary fuze means arranged to initiate detonation of the primary charges when the focal point is located beneath the surface of the target.

12. Munition according to claim 8 wherein the focal point lies on the line of target penetration.

13. Munition according to claim 8 wherein the liners are of different materials which react together exothermically when the penetrators meet at the focal point.

14. Munition according to claim 1 wherein each liner is made of a material having a density of less than 5 gm $cm^{-3}$.

15. Munition according to claim 14 wherein the material is selected from the group consisting of aluminium, alloys of aluminium, plastics, and plastics loaded with up to 50% by weight of particulate aluminium or particulate aluminium alloy.

16. Munition according to claim 14 wherein the forward face of each primary charge has a conical recess therein with an apex angle of from 15° to 70°.

17. Munition according to claim 16 wherein the apex angle is from 20° to 55°.

18. Munition according to claim 1 wherein each primary charge is displacable laterally outwards with respect to the fore-and-aft axis of target penetration on a moveable support mechanism from a confined position at which the primary charges are packed together in a cluster, to its detonatable position in the array.

19. Munition according to claim 18 wherein an energising means is positioned between the primary charges for activating the support mechanism to urge the primary charges towards their detonatable position in the array.

20. Munition according to claim 18 wherein the moveable support mechanism is engageable with latch means for restraining the primary charges at their detonatable positions in the array.

21. Munition according to claim 1 wherein the number of primary charges in the detonatable array is from three to six.

22. Munition according to claim 1 wherein said secondary charge is confined within a volume bounded by the lines of trajectory of said primary charges.

23. Munition according to claim 22 wherein the lines of trajectory converge towards one another forward of the detonatable array of primary charges and the secondary charge is tapered towards its forward end.

24. Munition according to claim 1 wherein the munition comprises an aerially-dispensable submunition dispensable from a multi-submunition dispenser.

25. Munition according to claim 1 wherein the primary charges are geometrically supported in the array such that the lines of trajectory are substantially parallel.

* * * * *